US007212647B2

(12) United States Patent
Kaneda et al.

(10) Patent No.: US 7,212,647 B2
(45) **Date of Patent: *May 1, 2007**

(54) VIBRATION ACTUATOR DEVICE OF PORTABLE TERMINAL

(75) Inventors: Shoichi Kaneda, Tokyo (JP); Takayuki Kumagai, Tokyo (JP); Yuichi Hashimoto, Tokyo (JP)

(73) Assignee: Namiki Seimitsu Houseki Kabushiki Kaisha, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 10/525,520

(22) PCT Filed: Sep. 5, 2003

(86) PCT No.: PCT/JP03/11393

§ 371 (c)(1),
(2), (4) Date: Oct. 12, 2005

(87) PCT Pub. No.: WO2004/023843

PCT Pub. Date: Mar. 18, 2004

(65) Prior Publication Data

US 2006/0153416 A1 Jul. 13, 2006

(30) Foreign Application Priority Data

Sep. 6, 2002 (JP) ..... 2002-261090

(51) Int. Cl.
*H04R 25/00* (2006.01)

(52) U.S. Cl. ..... 381/396; 381/345; 381/412

(58) Field of Classification Search ..... 381/396, 381/398, 400, 401, 412, 419, 420, 151, 189, 381/345, 351, 353, 354; 310/81; 335/222, 335/223; 340/388.1, 384.73

See application file for complete search history.

(56) References Cited

U.S. PATENT DOCUMENTS

| | | | | |
|---|---|---|---|---|
| 4,931,765 | A | 6/1990 | Rollins et al. | |
| 6,570,993 | B1 * | 5/2003 | Fukuyama | 381/396 |
| 6,847,139 | B2 * | 1/2005 | Ueda et al. | 310/81 |
| 6,850,138 | B1 * | 2/2005 | Sakai | 335/222 |

FOREIGN PATENT DOCUMENTS

| | | |
|---|---|---|
| JP | 11-007285 | 1/1999 |
| JP | 2000325879 | 11/2000 |
| JP | 2002219410 | 8/2002 |

* cited by examiner

*Primary Examiner*—Huyen Le
(74) *Attorney, Agent, or Firm*—Nixon Peabody LLP; Donald R. Studebaker

(57) ABSTRACT

By having multiple air passage holes 10*c* in the housing 1 and by creating a clearance G2 between the outer surface of the yoke 20 and the inner surface of the housing 1, the measurement of the clearance being confined to a range exceeding 0% but not exceeding 2.5% of the inner radius of the housing, the amount of air movement is limited by the clearance G2, and by this means the frequency range within which the desired acceleration can be attained is expanded.

9 Claims, 16 Drawing Sheets

VIBRATION ACTUATOR DEVICE OF PORTABLE TERMINAL

TECHNICAL FIELD

The present invention relates a device for notification of incoming calls, to be mounted in portable terminal equipment. Particularly, it relates to a multi-function vibrating actuator device that has the function of generating a vibration producing a bodily sensation, and the function of generating a ring tone; it principally relates to a multi-function vibrating actuator device with improved bodily-sensible vibration characteristics.

BACKGROUND ART

Multi-function vibrating actuator devices (referred to hereafter simply as "devices" as necessary) that generate both a bodily-sensible vibration and a ring tone in a single device are generally known, as means of notification of incoming calls in terminal equipment represented by portable telephones.

This sort of multi-function vibrating actuator device, as exemplified by the inner-magnet type shown in FIG. 24, comprises a housing 1 that is substantially cylindrical and open at both ends, a magnetic circuit 2 that includes a pole piece 2*a* and a yoke 2*b* fastened to a magnet 2*c* and separated by a gap G1 that functions as the magnetic gap, a diaphragm 4 that is fastened atop a voice coil 3, and suspensions 5, 5' that supports the magnetic circuit 2.

Within this device, the diaphragm 4 is mounted so as to cover one open end of the housing 1, such that the voice coil 3 is located within the magnetic gap G1 and the edge of the diaphragm 4 is fixed within one open end of the housing 1. The opening at the other end of the housing 1 is covered by a ring-shaped cover 6 that is fitted into the other open end of the housing 1. The voice coil 3 is electrically connected to terminal fittings 7*a* (7*b*) mounted on the outside of the housing 1 by lead wires that run from the diaphragm 4 to the outside of the housing 1.

The suspensions 5, (5'), as shown in FIG. 25 (both are the same shape, so only one suspension is shown), comprise a supporter 5*a* that is fixed to and supports the magnetic circuit, an outer ring 5*b* that is mounted inside the housing 1, and three spring arms 5*c* through 5*e* that are located at equal distances (separated by 120° in the example shown) and extend in the same direction from the outer edge of the supporter 5*a* (circumferential, in the example shown) to connect the supporter 5*a* and the outer ring 5*b* (see, for example, Patent Document 1).

The suspensions 5, 5' are mounted by fitting them inside the housing 1 so that the supporter 5*a* supports the magnetic circuit 2. In greater detail, spacer rings 8*a*, 8*b* are located in the spaces between the supporters 5*a* and the outer rings 5*b* of the suspensions 5, 5', and the supporter 5*a* that is fitted to the outside of the yoke 2*b* is held in place by a stopper ring 9; the outer ring 5*b* is held in place by the cover 6. In this way the magnetic circuit 2 is assembled so that it is supported and able to vibrate by flexing the spring arms 5*c* through 5*e*.

This multi-function vibrating actuator device is mounted in portable terminal equipment, and when a communication signal is received from elsewhere, a low-frequency electrical signal is impressed on the voice coil 3 and, by means of the electromagnetic action in the vicinity of the magnetic gap G1, the magnetic circuit 2 vibrates and that vibration is transmitted outwards. The user of the terminal equipment is made aware of the vibration as a bodily-sensible vibration, and the user is thus notified of the incoming call. On the other hand, if the incoming call causes a high frequency electrical signal to be impressed on the voice coil 3, the electromagnetic action in the vicinity of the same magnetic gap G1 causes the diaphragm 4 to vibrate and that vibration generates a ring tone or other sound, and the user is thus notified of the incoming call.

In conventional multi-function vibrating actuator devices, a large clearance G2' is maintained between the inner surface of the housing 1 and the outer surface of the yoke 2*b* in order to allow the flexing of the spring arms 5*c* through 5*e*. Accordingly, together with the vibration of the magnetic circuit 2, the air within the device moves freely within the device through the clearance G2, and so there is almost no resistance from the internal air to the vibration characteristics of the magnetic circuit 2. Therefore, the vibration of the magnetic circuit 2 quickly starts up at resonant frequencies, and the bodily-sensible vibration characteristics are limited to a narrow frequency range that yields the desired vibration acceleration.

For example, when the acceleration necessary for bodily-sensible vibration is at least A0 [G] as shown in FIG. 26, the range of frequencies at which that acceleration can be obtained is the narrow frequency range fa [Hz]. And as the maximum acceleration A1 [G] is approached, there is maximum bodily-sensible vibration at that point, or in other words it is a point of resonance, but as soon as the frequency reaches or exceeds f1 [Hz], the acceleration falls sharply, and above f3 [Hz] the acceleration falls below A0 [G] and the necessary acceleration is unavailable.

In the frequency range below f1 [Hz], on the other hand, the drop in acceleration is comparatively less steep, but there is still a drop, and at frequencies less than f4 [Hz] the acceleration is less than A0 [G]. Therefore, if the frequency varies even slightly from the point of resonance, there will be a sharp drop in the amount of bodily-sensible vibration.

For that reason, in the event that the manufacturing process causes a scattering of vibration characteristics from one device to the next, or that there are variations in the environment of use of the terminal equipment in which the devices are mounted, it will be difficult to set the point of resonance and the frequency range within which the desired vibration acceleration can be obtained will be narrow, as described above, and so the point of resonance can easily fall outside that frequency range.

Further, when there is a blow to the outer case of the portable terminal equipment in which the multi-function vibrating actuator device is mounted, the vibration is conveyed to the multi-function vibrating actuator device, and the magnetic circuit vibrates. In conventional multi-function vibrating actuator devices, the magnetic circuit is supported by suspensions having the structure described above, and so the vibration characteristics of the magnetic circuit, as measured through the outer case, follow the curve shown in FIG. 27. The vertical axis of FIG. 27 indicates the amplitude of vibration of the magnetic circuit, and the horizontal axis shows the passage of time.

According to these vibration characteristics, if vibration is conveyed to the device when the portable terminal equipment in which the multi-function vibrating actuator device is mounted is awaiting an incoming call, or in other words, when the multi-function vibrating actuator device is not in operation, the magnetic circuit will vibrate for some time and cause vibration of the air, which will produce a strange noise like a plucked bowstring.

[Patent Document 1] Japanese Patent Laid-Open Publication No. 2002-1215

DISCLOSURE OF THE INVENTION

The inventors of the present invention ascertained, as a result of diligent development, that using the air within the device as a damper is effective in terms of improving the stability of the vibration characteristics of the magnetic circuit. A primary object of the present invention is to adjust the size of the clearance between the inner surface of the housing and the outer surface of the magnetic circuit and thereby control the movement of the interior air in the space formed by the diaphragm and the magnetic circuit and the movement and the interior air in the space formed by the magnetic circuit and the cover, as well as improve the stability and utility of the vibration characteristics.

In addition, terminal equipment for portable use generally has performance and specifications that vary with each manufacturer, and so the individual parts mounted in that terminal equipment have performance and specifications that differ according to the demands of each manufacturer. Accordingly, an auxiliary object of the present invention is to adjust the size of the clearance between the inner surface of the housing and the outer surface of the magnetic circuit and thereby adjust and limit the movement of interior air within the device, as well as to enable easy realization of bodily-sensible vibration characteristics that meet the demands of each manufacturer.

Further, there is the object of adjusting and limiting the size of the clearance between the inner surface of the housing and the outer surface of the magnetic circuit and thereby, in combination with other methods, adjusting and limiting the movement of air between the space formed by the diaphragm and the magnetic circuit and the space formed by the magnetic circuit and the cover, and so achieve the stability and utility of the vibration characteristics.

Moreover, another object of the present invention is to constitute the device to enable reduction of the occurrence of the strange noise, like a plucked bowstring, caused by vibration of the magnetic circuit if the outer case of the portable terminal equipment in which the multi-function vibrating actuator device is mounted is awaiting an incoming call.

Issues other than the objects stated above, along with concrete features, should become apparent in the course of explanations based on embodiments of the present invention.

In a multi-function vibrating actuator device according to claim 1 of the present invention, an outer-magnet type of magnetic circuit is provided, an air passage hole is formed at least at one part among the housing, cover and diaphragm, the magnetic circuit including the yoke, yoke palate and magnet is assembled with an outer surface thereof in close proximity to an inner surface of the housing so as to create a clearance between an outer surface of the magnetic circuit and an inner surface of the housing that measures more than 0% and not more than 2.5% of the inside radius of the housing, and the amount of movement of interior air in a space formed by the diaphragm and the magnetic circuit and of interior air in a space formed by the magnetic circuit and the cover is restricted by the clearance so as to expand a range of frequencies at which the magnetic circuit is able to vibrate.

In the multi-function vibrating actuator device according to claim 2 of the present invention, the yoke plate includes a ring with brim projections at an outer periphery of the ring in accordance with the number of spring arms, the brim projections being arranged so as not to overlap points of attachment between the housing and suspension.

In the multi-function vibrating actuator device according to claim 3 of the present invention, a through hole is formed in the magnetic circuit.

In the multi-function vibrating actuator device according to claim 4 of the present invention, an air passage hole is formed at least at one part among the housing, cover and diaphragm, a ring is fitted around an outer periphery of the magnetic circuit so as to create a clearance between an outer surface of the ring and an inner surface of the housing that measures more than 0% and not more than 2.5% of the inside radius of the housing, and the amount of movement of interior air in a space formed by the diaphragm and the magnetic circuit and of interior air in a space formed by the magnetic circuit and the cover is restricted by the clearance so as to expand a range of frequencies at which the magnetic circuit is able to vibrate.

In the multi-function vibrating actuator device according to claim 5 of the present invention, an inner-magnet type of magnetic circuit is provided, an air passage hole is formed at least at one part among said housing, cover and diaphragm, said magnetic circuit is assembled with an outer surface thereof in close proximity to an inner surface of the housing so as to create a clearance between an outer surface of the magnetic circuit and an inner surface of the housing that measures more than 0% and not more than 2.5% of the inside radius of the housing, and the amount of movement of interior air in a space formed by said diaphragm and said magnetic circuit and of interior air in a space formed by said magnetic circuit and said cover is restricted by said clearance so as to expand a range of frequencies at which said magnetic circuit is able to vibrate.

In the multi-function vibrating actuator device according to claim 6 of the present invention, there are provided a magnetic circuit forming a magnetic path, a suspension supporting the magnetic circuit, a diaphragm being placed facing the magnetic circuit, a voice coil being inserted into a magnetic gap formed in the magnetic circuit, and a housing enclosing the magnetic circuit, and the magnetic circuit is placed so as to create a clearance between an outer surface of the magnetic circuit and an inner surface of the housing and this clearance restricts the amount of air movement that measures more than 0 mm and not more than 0.2 mm.

In the multi-function vibrating actuator device according to claim 7 of the present invention, there are provided a movable part including a magnetic circuit that forms a magnetic path and a brim that extends in a radial direction of the magnetic circuit, a suspension supporting the movable part, a diaphragm being placed facing the movable part, a voice coil being inserted into a magnetic gap formed in the magnetic circuit, and a housing enclosing the movable part, and the movable part is placed so as to create a clearance between an outer surface of the movable part and an inner surface of the housing and this clearance restricts the amount of air movement that measures more than 0 mm and not more than 0.2 mm.

In the vibrating actuator device according to claim 8 of the present invention, there are provided a magnetic circuit forming a magnetic path, a suspension supporting the magnetic circuit, a voice coil being inserted into a magnetic gap formed in the magnetic circuit, and a housing enclosing the magnetic circuit, and the magnetic circuit is placed so as to create a clearance between an outer surface of the magnetic circuit and an inner surface of the housing and this clearance restricts the amount of air movement that measures more than 0 mm and not more than 0.2 mm.

In the vibrating actuator device according to claim 9 of the present invention, there are provided a movable part including a magnetic circuit that forms a magnetic path and a brim that extends in a radial direction of the magnetic circuit, a suspension supporting the movable part, a voice coil being inserted into a magnetic gap formed in the magnetic circuit, and a housing enclosing the movable part, and the movable part is placed so as to create a clearance between an outer surface of the movable part and an inner surface of the housing and this clearance restricts the amount of air movement that measures more than 0 mm and not more than 0.2 mm.

BEST MODE FOR CARRYING OUT THE INVENTION

The illustrated embodiments that follow are primarily multi-function vibrating actuator devices of the outer-magnet type. Within their constitution there are many constituent parts in common with the conventional actuator, and a duplicative explanation of those parts has been omitted. Now, for convenience of description, the device as a whole is described with the diaphragm side as "up" and the cover side as "down."

<Basic Structure of the Device as a Whole>

Figure 1:
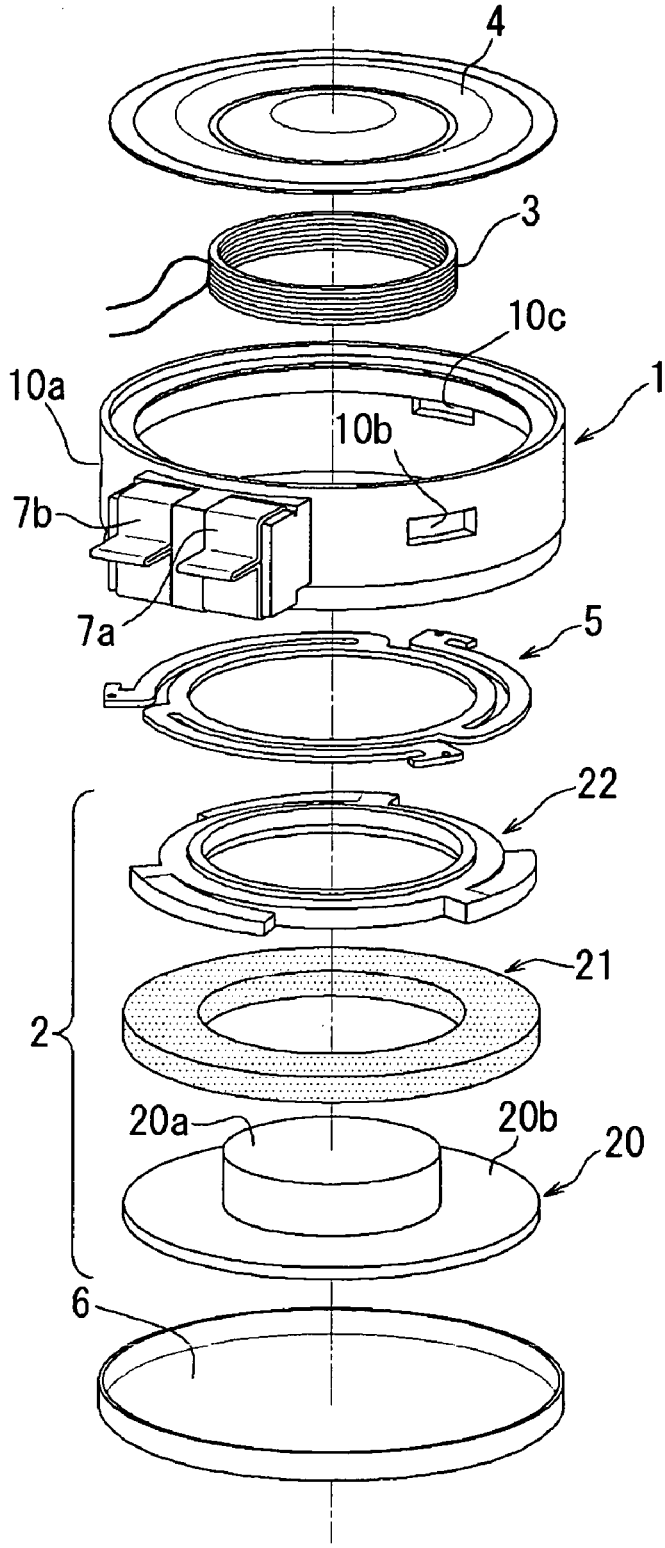
FIG. 1 is an exploded perspective view showing constituent parts of the multi-function vibrating actuator device of the present invention.

FIGS. 1 through 5 show the basic structure of the multi-function vibrating actuator device of the present invention as a whole. In this basic structure, as shown in FIG. 1, there is provided an outer-magnet type magnetic circuit that comprises a yoke 20 that includes a pole piece 20*a* in the center of a round plate 20*b*, a ring magnet 21, and a substantially ring-shaped yoke plate 22 fastened together as a unit. The device as a whole also comprises a substantially cylindrical housing 1 that is open at both ends, a diaphragm 4 fastened to the top of a voice coil 3, one suspension 5, and a cover 6.

Figure 2:
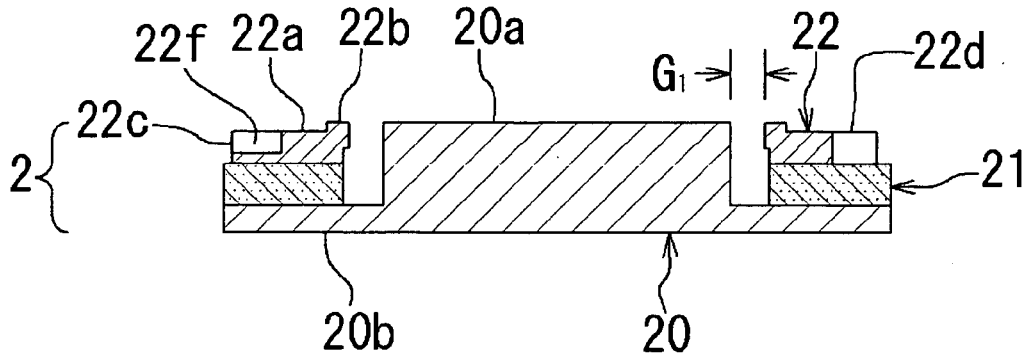
FIG. 2 is a cross section view showing the magnetic circuit to be assembled into the multi-function vibrating actuator device of FIG. 1.

The magnetic circuit 2, as shown in FIG. 2, includes the pole piece 20*a* within the inside diameter of the magnet 21 and the yoke plate 22, and the gap G1 that functions as a magnetic gap is the gap between the outer surface of the pole piece 20*a* and the inner surfaces of the magnet 21 and the yoke plate 22. The three pieces—the yoke 20, the yoke plate 22, and the magnet 21 in the center—are fastened together as a single unit of the outer-magnet type.

Figure 3:
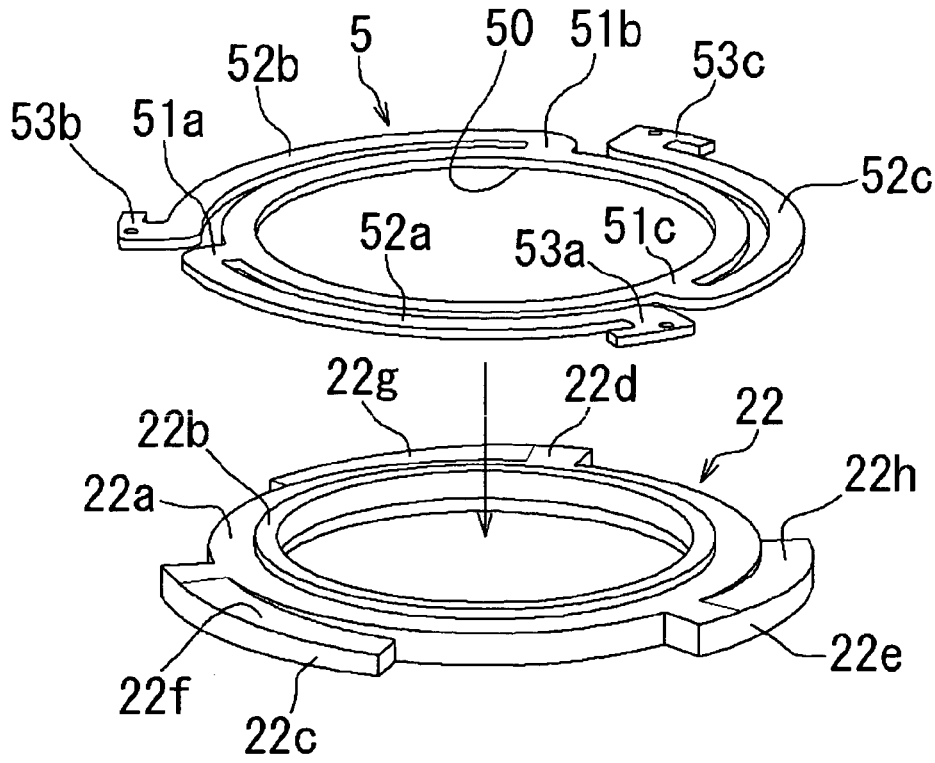
FIG. 3 is an exploded perspective view showing the suspension and yoke plate to be assembled into the multi-function vibrating actuator device of FIG. 1.

The suspension 5, as shown in FIG. 3, comprises a circular supporter 50, which is fixed to and supports the magnetic circuit 2, and three spring arms 52*a* through 52*c* that extend in the same direction from root points 51*a* through 51*c* located at equal distances with a 120° separation, following the shape of the supporter 50. At the tips of the spring arms 52*a* through 52*c* there are attachment blades 53*a* through 53*c* for attachment to the housing 1.

The yoke plate 22, as shown in FIG. 3, is made up primarily of a ring 22*a* with a retaining ring 22*b* that holds the supporter 50 running along the inner circumference. On the outside surface of the ring 22*a* there are three brim projections 22*c* through 22*e*, in accordance with the number of spring arms, located at equal distances with a 120° separation in order to effectively guide the magnetic flux from the magnet 21 in the magnetic gap G1.

The location and circumferential length of these brim projections 22*c* through 22*e* should be set not to overlap the attachment blades 53*a* through 53*c*, so that they will not contact the attachment blades 53*a* through 53*c* when the magnetic circuit 2 vibrates upward to top dead center. Moreover, the brim projections 22*c* through 22*e* have tapers 22*f* through 22*h* that slope down from the root points 51*a* through 51*c* toward the attachment blades 53*a* through 53*c*, in order to avoid contact with the spring arms 52*a* through 52*c* when the magnetic circuit 2 vibrates upward.

Figure 4:
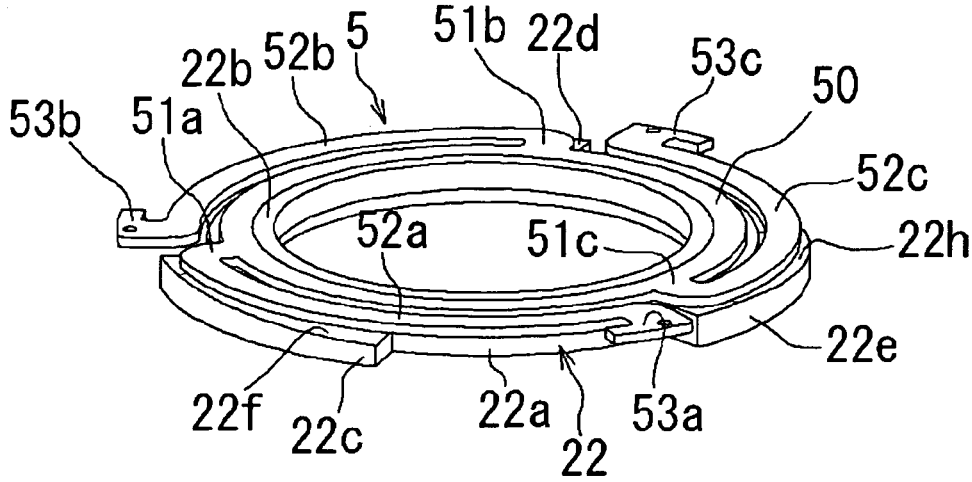
FIG. 4 is a perspective view showing the assembled suspension and yoke plate of FIG. 3.

The suspension 5, as shown in FIG. 4, has the supporter 50 for the magnetic circuit 2 fitted to the retaining ring 22*b* of the yoke plate 22 and positioned on the upper surface of the ring 22*a*. It is assembled and fixed to the yoke plate 22 with the root points 51*a* through 51*c* over the non-tapered surface of the brim projections 22*c* through 22*e*, the spring arms 52*a* through 52*c* over the tapers 22*f* through 22*h*, and the attachment blades 53*a* through 53*c* close to the edges of the brim projections 22*c* through 22*e*.

Figure 5:
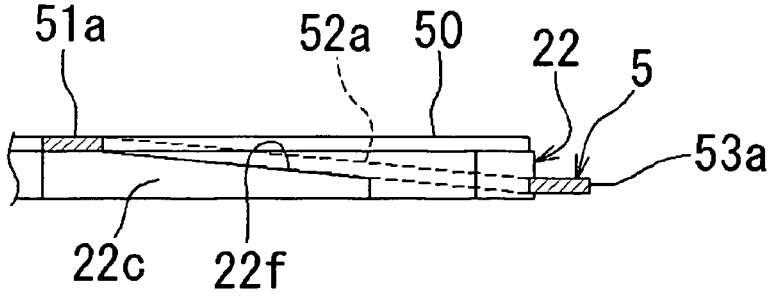
FIG. 5 is a side view showing, in the flexed state, the suspension spring arm in the assembled state of FIG. 4.

By means of this constitution, as shown in FIG. 5, the spring arms 52*a* through 52*c* are permitted to flex and deflect above the tapers 22*f* through 22*h*, and so the magnetic circuit 2 is formed with the yoke plate 22 mounted in relation to the magnetic circuit 2 in such a way that it can vibrate greatly before reaching top dead center.

The suspension 5 has the attachment blades 53*a* through 53*c* of the spring arms 52*a* through 52*c* attached to the sides of the housing 1, and so supports the magnetic circuit 2 within the housing 1. The diaphragm 4 is positioned with the voice coil 3 inside the magnetic gap G1, and its outer edge is fastened to the rim of the opening of the housing 1, thus covering one end of the housing 1. The cover 6 is assembled to cover the other open end of the housing 1, with its outer edge fitted to the rim of the other open end of the housing 1.

<Overview of Embodiments>

Three illustrated embodiments are presented under this basic structure. The first embodiment has air passage holes in the housing, and a clearance formed between the outer surface of the magnetic circuit and the inner surface of the housing. The second embodiment has a clearance formed by varying the amount of projection from the outer surface of the magnetic circuit. The third embodiment has through holes in the magnetic circuit in addition to air passage holes in the housing.

In each of these embodiments, the measurement of the clearance is set at more than 0 mm and not more than 0.2 mm, preferably at least 0.05 mm and not more than 0.15 mm, in order to keep the clearance in a range between 0% and 2.5% of the inside radius of the housing. By this means, vibration of the magnetic circuit within a narrow clearance is permitted, and the amount of movement of the interior air in the space formed by the diaphragm and the magnetic circuit and of the interior air in the space formed by the magnetic circuit and the cover is restricted by the clearance, by which means it is possible to expand the range of frequencies at which the magnetic circuit is able to vibrate.

<First Embodiment>

Figure 6:
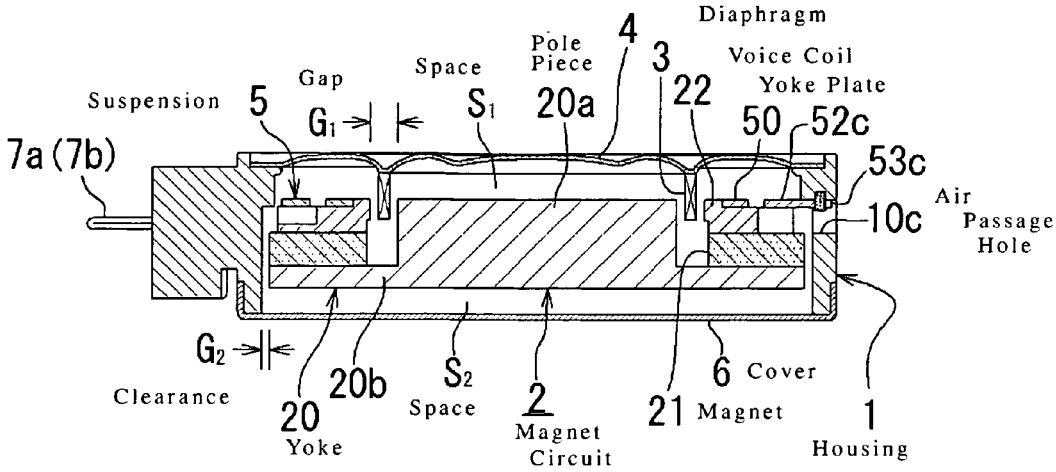
FIG. 6 is a cross section view showing the multi-function vibrating actuator device according to the first embodiment of the present invention.

In the first embodiment, as shown in FIGS. 1 and 6, a number of air passage holes 10*a* through 10*c* have been opened in the side of the housing 1. Further the outer surface of the round plate 20*b* of the yoke 20 has been made to closely approach the inner surface of the housing 1, and so a clearance G2 is formed between the outer surface of the yoke and the inner surface of the housing. This limits the amount of reciprocal movement of the interior air in the space S1 formed by the diaphragm 4 and the magnetic circuit 2 and the interior air in the space S2 formed by the magnetic circuit 2 and the cover 6.

In this embodiment there are, in the side of the housing 1, three air passage holes (see 10*a* through 10*c* in FIG. 1) to match the number of spring arms 52*a* through 52*c* of the suspension 5; these air passage holes are also used for attachment of the attachment blades (see 53*a* through 53*c* in FIG. 1) on the spring arms (see 10*c* and 53*c* of FIG. 6). By this means, the suspension 5 is installed within the housing. Further, this allows an air-tight structure for the diaphragm 4 and the cover 6.

Figure 7:
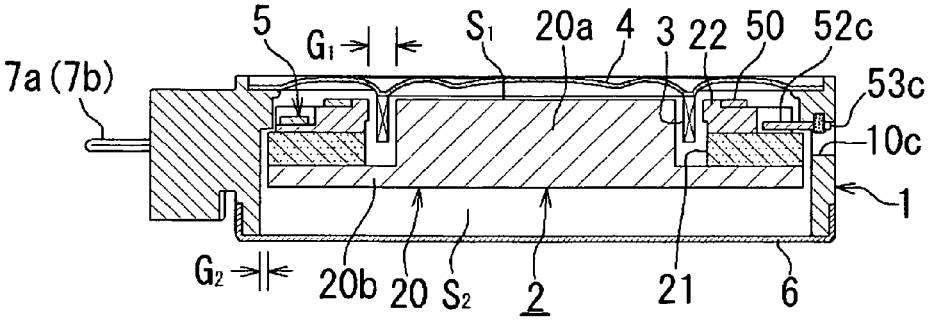
FIG. 7 is an explanatory diagram showing the operation of the multi-function vibrating actuator device of FIG. 6 at the top dead center.
Figure 8:
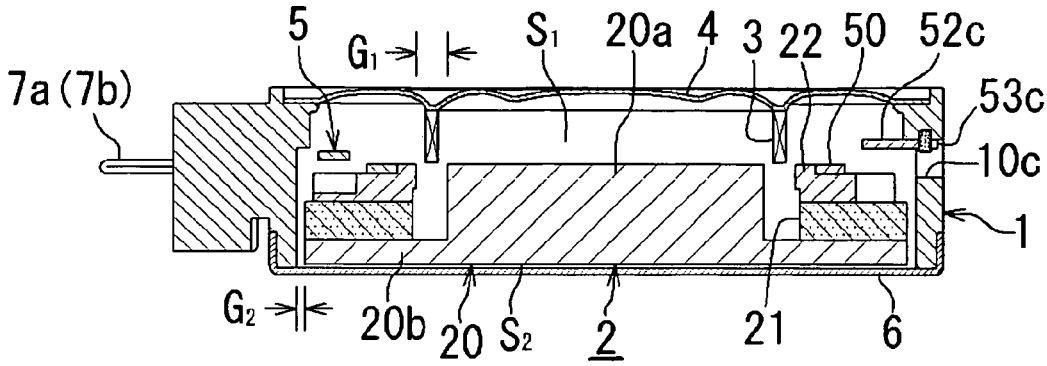
FIG. 8 is an explanatory diagram showing the operation of the multi-function vibrating actuator device of FIG. 6 at the bottom dead center.

As shown in FIGS. 7 and 8, when an electrical signal of at least 100 Hz and not more than 200 Hz—preferably between 120 and 160 Hz—is impressed on the voice coil 3, the electromagnetic operation of the magnetic circuit 2 and the voice coil 3 in the vicinity of the magnetic gap causes the magnetic circuit 2 to vibrate up and down within the housing 1, flexing the spring arms 52*a* through 52*c* while maintaining the magnetic gap G1. When the magnetic circuit 2 vibrates up and down, the motion is transferred to the air within the device—that is, to the interior air in the space S1 formed by the diaphragm 4 and the magnetic circuit 2 and the interior air in the space S2 formed by the magnetic circuit 2 and the cover 6—and that air also moves up and down.

Regarding the air as a fluid, the air that moves up and down in the two spaces S1, S2 passes back and forth between the space S1 and the space S2 through the clearance G2. This clearance G2 is made as narrow as possible by having the outer surface of the yoke 3 approach the inner surface of the housing 1 to a measurement in a range greater than 0% but not more than 2.5% of the inside radius R of the housing 1; that is, in a range greater than 0 mm and not more than 0.2 mm, and preferably at least 0.05 mm and not more than 0.15 mm. Consequently, the interior air in the spaces S1, S2 applies air pressure created by the up and down fluid motion to the small clearance G2. Because it is difficult for air to pass through the small clearance G2 with this additional air pressure, the result is to limit the movement of the air in the spaces S1, S2 between the two spaces.

Figure 9:
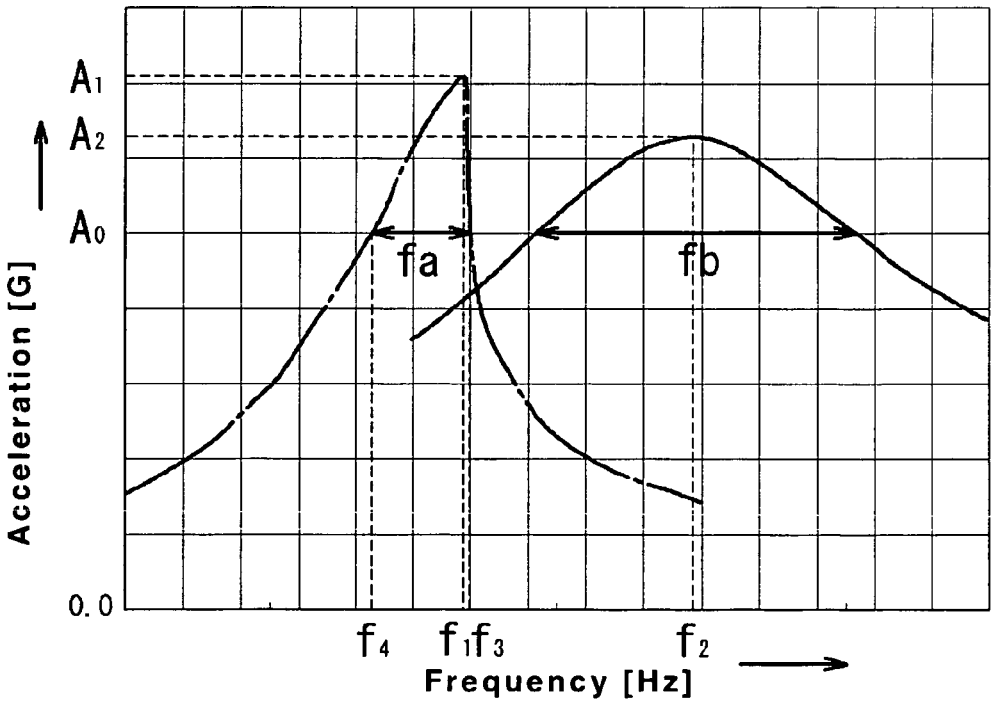
FIG. 9 is a properties graph that shows a comparison of the vibration characteristics of the multi-function vibrating actuator device of the present invention and a conventional multi-function vibrating actuator device.

Because the air thus restricted tends to remain in its respective space S1, S2, that residual air functions as a damper to restrain the up and down vibration of the magnetic circuit 2. Accordingly, the amplitude of the up and down vibration of the magnetic circuit 2 is controlled, and so there is reduced variation in acceleration relative to variation in frequency, as shown by the solid curve in FIG. 9, yielding vibration characteristics with gentle slopes. These vibration characteristics display the following results.

Figure 24:
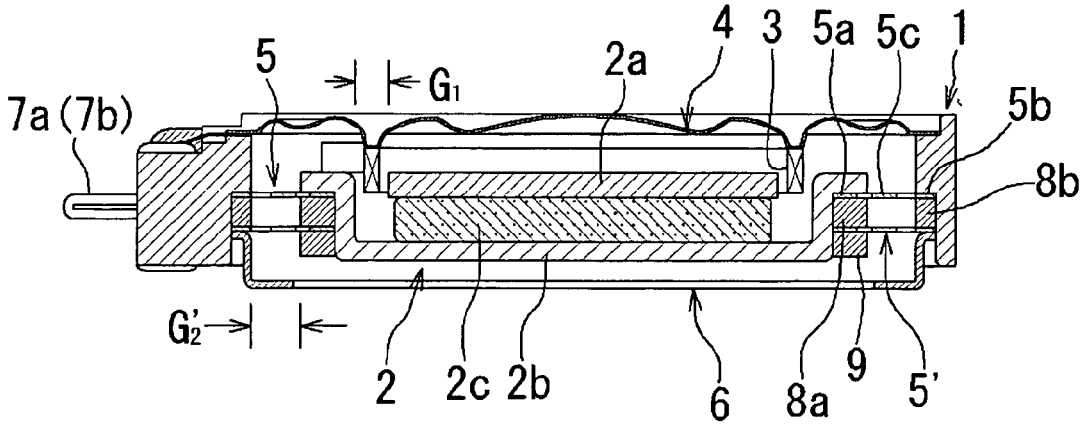
FIG. 24 is a cross section view showing a conventional multi-function vibrating actuator device.
Figure 25:
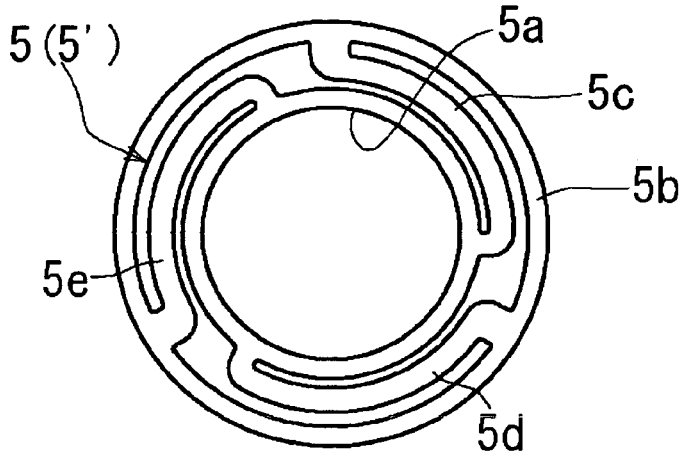
FIG. 25 is a plane view showing an example of the suspension assembled in the conventional multi-function vibrating actuator device.
Figure 26:
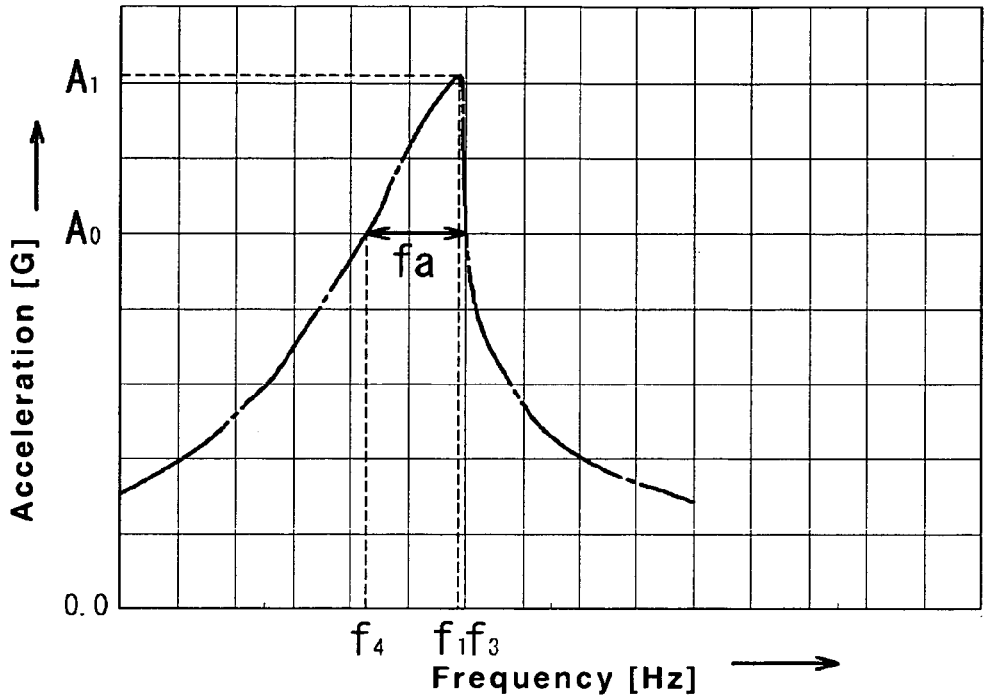
FIG. 26 is a properties graph that shows the vibration characteristics of the conventional multi-function vibrating actuator device.
Figure 27:
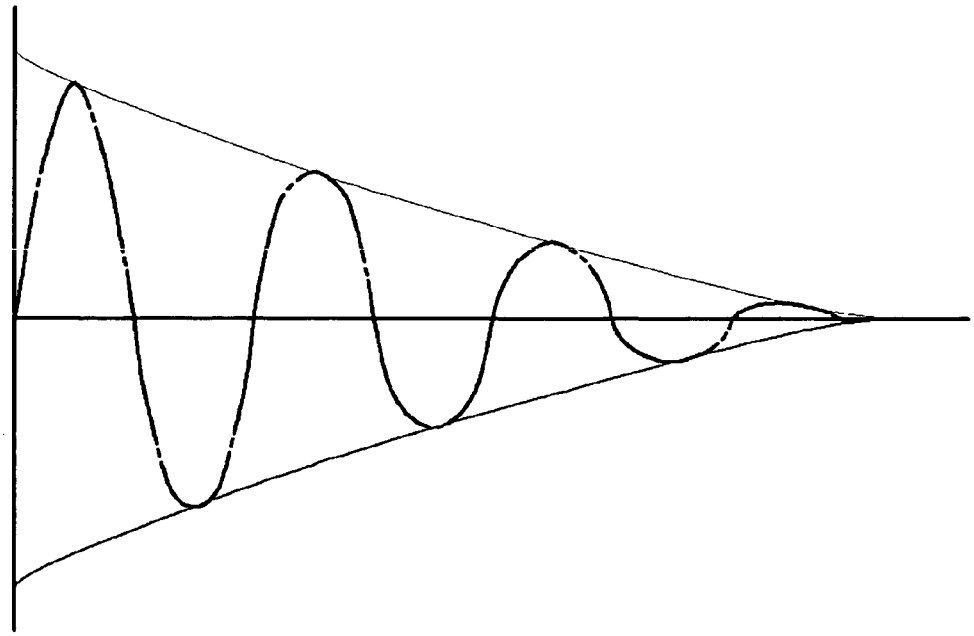
FIG. 27 is a curve diagram that shows the vibration characteristics of the magnetic circuit, as measured through the outer case of the portable terminal equipment in which the conventional multi-function vibrating actuator device is mounted.

First, this embodiment yields the acceleration required for bodily-sensible vibrations over a wide range of frequencies. If the acceleration required for bodily-sensible vibrations is set at A0 [G] and above, the frequency range within which such acceleration is achieved with the conventional actuator shown in FIG. 24 is the frequency range fa [Hz] shown by long-and-short dash curve in FIG. 9. In contrast, the present invention clearly widens that range to range fb [Hz] as shown by the solid curve in FIG. 9. Accordingly, it is difficult for the point of resonance to drift from that frequency range, and so the point of resonance is easily determined. Therefore, the desired vibration acceleration is easily attained, and the stability and utility of bodily-sensible vibration characteristics can be improved.

Second, there is less fall-off in the amount of bodily-sensible vibration. With the present invention, the maximum acceleration A2 [G] is obtained in the vicinity of the frequency f2 [Hz], as shown by the solid curve in FIG. 9. Since A1 [G]>A2 [G], the maximum acceleration is reduced, but compared with the conventional actuator, the drop in acceleration can be slight relative to the range of frequency variation.

Accordingly, even if, in the course of manufacturing, bodily-sensible vibration characteristics vary because of different points of resonance in individual multi-function vibrating actuator devices, or if points of resonance differ because of variations in the environments for use of terminal equipment in which the multi-function vibrating actuator devices are mounted, this embodiment blocks a sharp fall-off in the amount of bodily-sensible vibration, and prevents a situation in which the required amount of bodily-sensible vibration (greater than A0 [G] in FIG. 9) cannot be obtained.

In this first embodiment, the outflow of air is restricted because the air within the device is used as a damper, but because the air passage holes 10*a* through 10*c* are opened in the side of the housing 1, when the diaphragm 4 is vibrating the air within the space S1 leaves the device through air passage holes 10*a* through 10*c*, and excessive expansion of the space S1 is prevented. Accordingly, adverse effects on the vibration characteristics of the diaphragm during low-range sound production are prevented.

As described above, in devices that generate both sound and bodily-sensible vibrations, opening air passage holes 10*a* through 10*c* improves the stability and utility of bodily-sensible vibration characteristics without sacrificing acoustic characteristics; this is an extremely effective means.

<Second Embodiment>

In keeping with the demands of manufacturers of portable terminals, different characteristics and specifications are sometimes given to individual parts mounted in terminal equipment. For this reason, there are variations in the bodily-sensible vibration characteristics requested, and so there is no such thing as uniformly ideal bodily-sensible vibration characteristics. That being the case for multi-function vibrating actuator devices mounted in terminal equipment, it cannot be said that it is always best to make the clearance G2 as small as possible as described for the first embodiment; it becomes necessary to make slight changes in the internal structure of the device in accordance with various demands.

In the second embodiment, in order to meet these demands, the size of the yoke 20 is changed in the facial direction (in the direction of the diameter of the round plate 20*b*). Specifically, the yoke is made variously within the range in which the interior air functions as a damper; that is, where the clearance measurement relative to the inner radius of the housing is more than 0% and not more than 2.5%, or more than 0 mm and not more than 0.2 mm, preferably at least 0.05 mm and not more than 0.15 mm. By adjusting and limiting the movement of interior air between spaces S1 and S2 in this way, it is possible to adjust the damping action that the air puts on the up and down vibration of the magnetic circuit.

Figure 10:
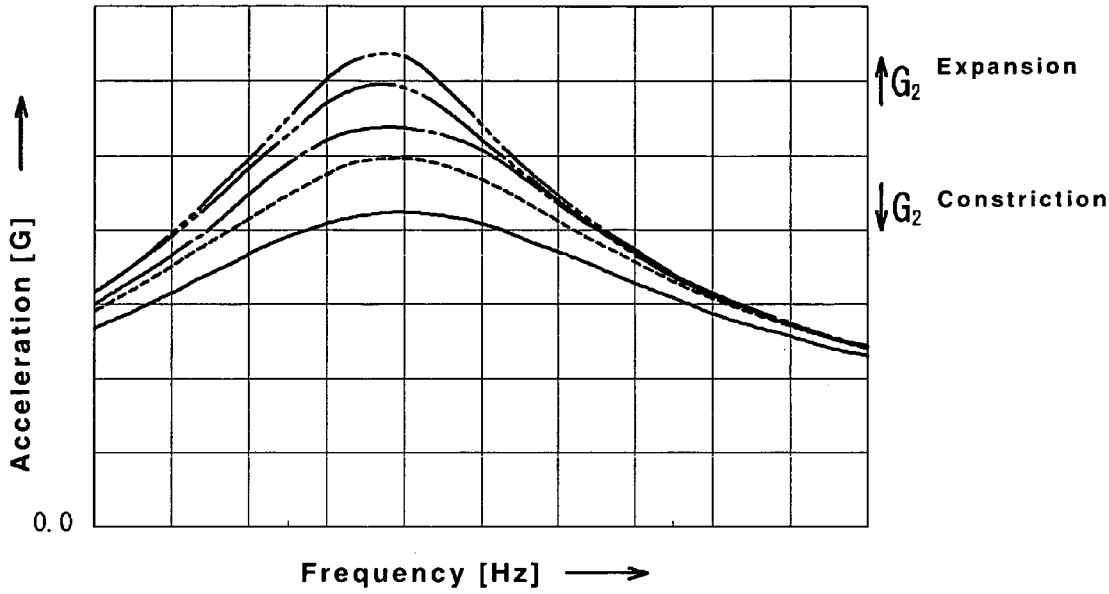
FIG. 10 is a properties graph that shows the relationship between the clearance of the multi-function vibrating actuator device of the present invention and its vibration characteristics.

By enlarging the size of the clearance G2, it becomes possible to increase the acceleration as modeled in FIG. 10. By reducing the size of the clearance G2, on the other hand, it is possible to gently reduce the acceleration and expand the frequency range.

Now, in all the cases of vibration characteristics shown in FIG. 10, the same electrical signal is impressed on the voice coil, but the size of the clearance is varied. It is possible, however, to increase the acceleration by increasing the power of the electrical signal. Accordingly, by striking a balance between the desired amount of vibration and the size of the electrical signal impressed, it is possible to adjust the sharpness of the resonance, and design a setting of vibration characteristics that meets requirements.

Figure 11:
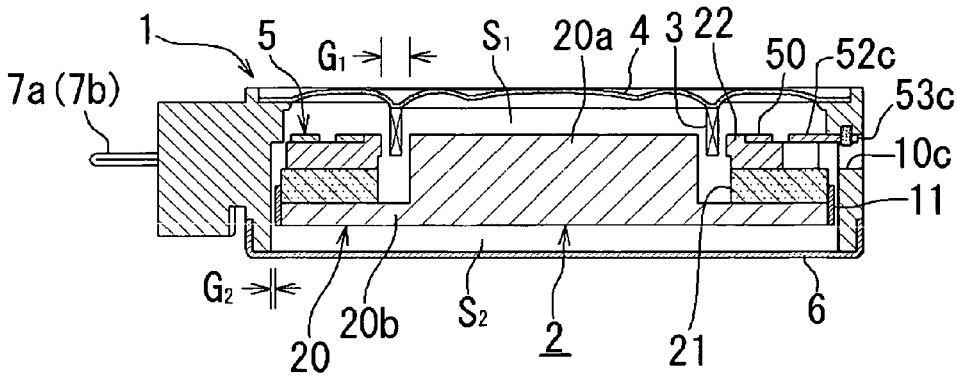
FIG. 11 is a cross section view showing the multi-function vibrating actuator device according to the second embodiment of the present invention.
Figure 12:
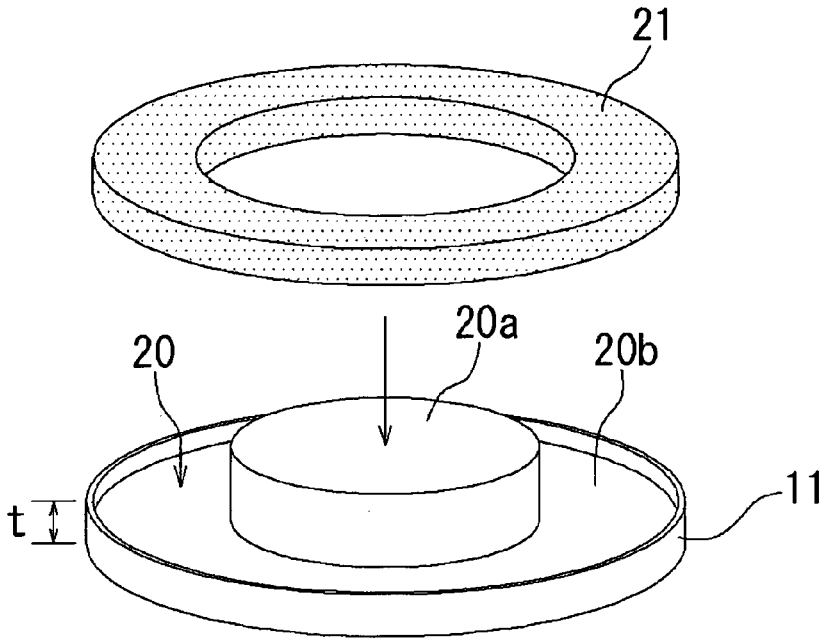
FIG. 12 is an exploded perspective view of the yoke, magnet and ring to be assembled in the multi-function vibrating actuator device of FIG. 11.

To manufacture the yoke 20 in different sizes depending on individual requirements, as described above, incurs production costs and the time and labor required for manufacture. For that reason, it is preferable to fit a ring 11 to the outer surface of the yoke 20, as shown in FIGS. 11 and 12, in order to facilitate assembly and to reduce the production cost and time and labor of changing the clearance G2. In greater detail, the round plate 20*b* is manufactured with a smaller radius than needed for the predetermined clearance size, and several patterns are prepared for rings of different sizes in the direction parallel to the diameter (the facial direction of ring 11).

By simply fitting this ring 11 around the outer surface of the ring plate 20*b* of the yoke 20, it is possible to freely change the size of the clearance G2 between the outer surface of the magnetic circuit 2 and the inner surface of the housing 1. The size of this ring 11 can be changed within a range such that the outer surface of the ring 11 will not contact the inner surface of the housing 1 when the magnetic circuit that comprises the yoke 20 to which the ring 11 is fitted vibrates up and down. Moreover, the thickness measurement t of the ring 11 is set to extend to the outer diameter of the magnet 21, so that the prescribed air movement will depend on the inner diameter of the housing 1.

By this means, the size of the yoke 20 can be set in a standard way, and so it is not necessary to produce the yoke 20 in different sizes. Further, the size of the inner periphery of the ring 11 is the same as the outside size of the yoke 20, and so that need not be changed; the only thing to change is the outside size of the ring. Therefore, it is possible to freely vary the sharpness of resonance, the fall-off of acceleration and the width of the frequency band in coordination with the electrical signal, and at the same time to reduce production costs and the time and labor required for manufacture.

The ring 11 can be made of a polymer or other material that is non-magnetic and not subject to elastic deformation. If a ring subject to elastic deformation were fitted to the yoke, it would deform and be crushed if an external shock caused the outer surface of the ring to contact the inner surface of the housing. That would prevent further displacement of the yoke, and ultimately prevent enlargement of the displacement value of the magnetic circuit. It is thought that when the displacement value in the direction of the diameter is enlarged, the suspension that is fixed to the yoke twists and cannot return to its original shape, and becomes damaged.

It is also possible to change the structure by fixing the ring to the inner surface of the housing 1, to form the clearance between the inner diameter of the ring and the round plate 20*b*. In that event, the clearance can be changed-by altering the measurement of the inner surface of the ring.

<Third Embodiment>

Figure 13:
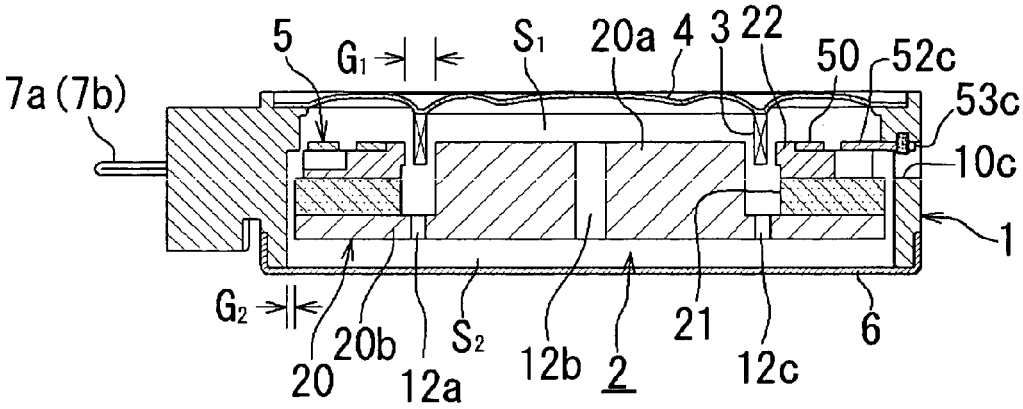
FIG. 13 is a cross section view showing the multi-function vibrating actuator device according to the third embodiment of the present invention.

The third embodiment is constituted to set and change the bodily-sensible vibration characteristics by placing through holes 12*a* through 12*c* in the yoke 20, as shown in FIG. 13, in addition to the air passage holes 10*a* through 10*c* and the clearance G2 described above. The through holes 12*a* through 12*c* are bored through the yoke 20 in order to regulate and limit the amount of movement of interior air between spaces S1 and S2.

The positions for piercing the through holes can be selected from both the pole piece 20*a* and the round plate 20*b*, as shown in the drawing, or either the pole piece 20*a* or the round plate 20*b*. The number of holes should be one or two, from the need to maintain the weight balance of the magnetic circuit, or that can be changed to three or six spaced at regular intervals around the periphery.

Figure 14:
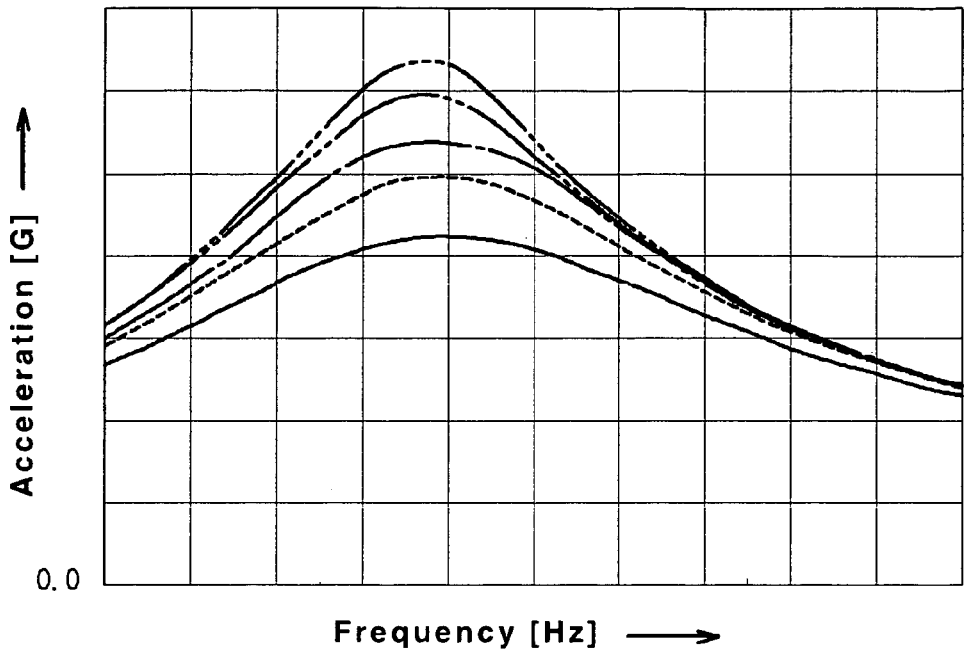
FIG. 14 is a properties graph that shows changes in the vibration characteristics of the multi-function vibrating actuator device in accordance with the number of through holes made in the yoke of FIG. 13.

Assuming a fixed value for the power of the electrical signal impressed on the voice coil, it is possible to bring about different vibration characteristics depending on the number of through holes, as shown in FIG. 14, which shows the cases of no holes (solid curve), one hole (broken curve), two holes (one long/one short dash curve), three holes (one long/two short dash curve), and four holes (one long/three short dash curve).

As shown in FIG. 14, the vibration acceleration increases with the number and area of the through holes. That is, as the hole area increases, the movement of interior air between spaces S1 and S2 becomes easier, the air pressure from the interior air in the space S1 is reduced, and its function as a damper is lessened. In consequence, the sharpness of resonance, the drop-off in acceleration, and the width of the frequency range can be made to vary in accordance with the number and area of the holes. In addition, it is possible to increase acceleration even if the power of the electrical signal impressed on the voice coil is large. Therefore, it is desirable to set the number and area of the holes in balance with the strength of the electrical signal.

In this third embodiment, changes in the bodily-sensible vibration characteristics are brought about by changing the number and area of through holes, within the range where the clearance G2 has a damper function. Accordingly, it is not necessary to make the yoke in different sizes, not to produce an additional part like the ring in embodiment 2, which enhances the stability and utility of the bodily-sensible vibration characteristics. Further, in comparison to the third embodiment, this embodiment enables easier changes of vibration characteristics, and it enables changes while holding down production costs and the time and labor required in manufacture.

<Principle of Reduction of Strange Noise>

If there is a blow to the outer case of the portable terminal equipment in which the multi-function vibrating actuator device is mounted, the vibration is transferred to the multi-function vibrating actuator device; the magnetic circuit will vibrate for some time and cause vibration of the air, which will produce a strange noise like a plucked bowstring. However, in all of the embodiments described above, the interior air within the device functions as a damper to block vibration of the magnetic circuit, and so vibration of the magnetic circuit is suppressed and quickly returns to normal.

Figure 15:
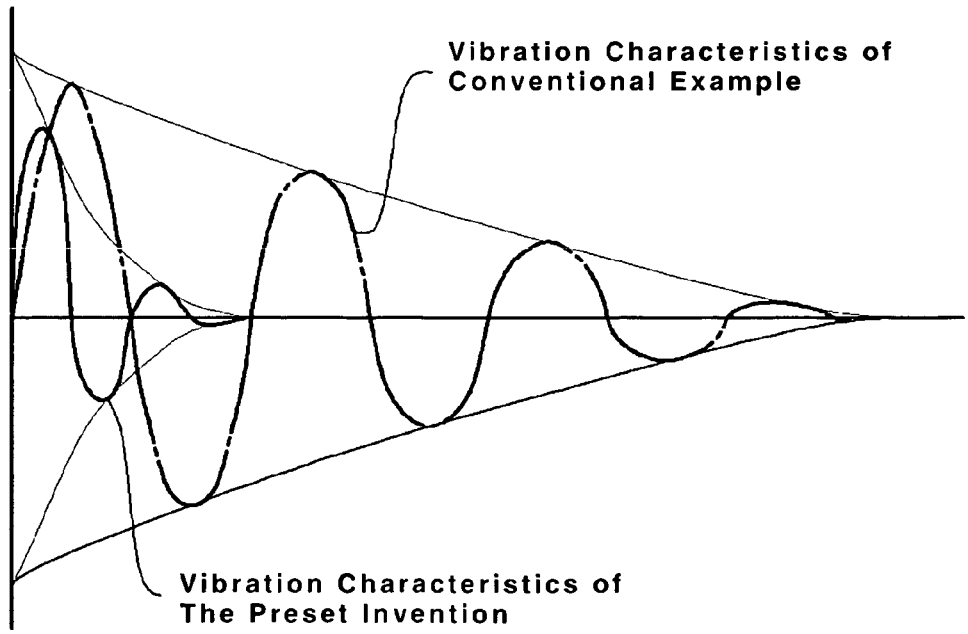
FIG. 15 is a curve diagram that shows the vibration characteristics of the magnetic circuit, as measured through the outer case of the portable terminal equipment in which the multi-function vibrating actuator device of the present invention is mounted, in comparison with a conventional multi-function vibrating actuator device.
Figure 16:
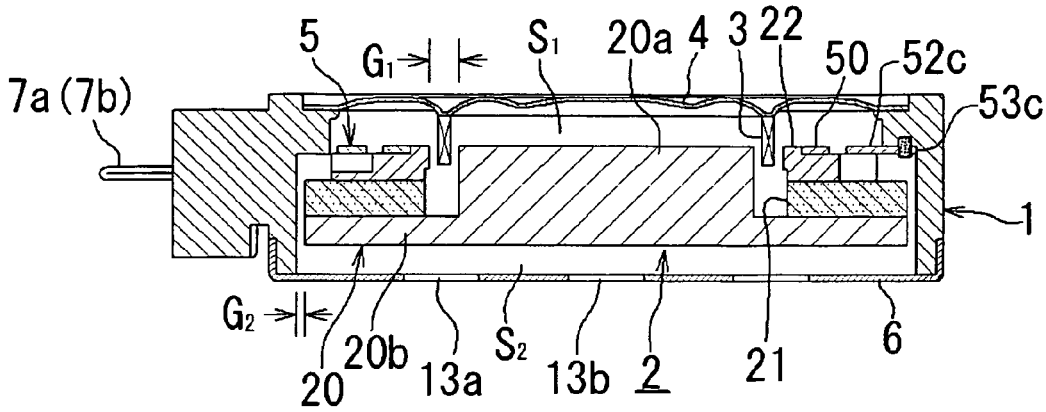
FIG. 16 is a cross section view showing the multi-function vibrating actuator device according to another embodiment of the present invention.
Figure 17:
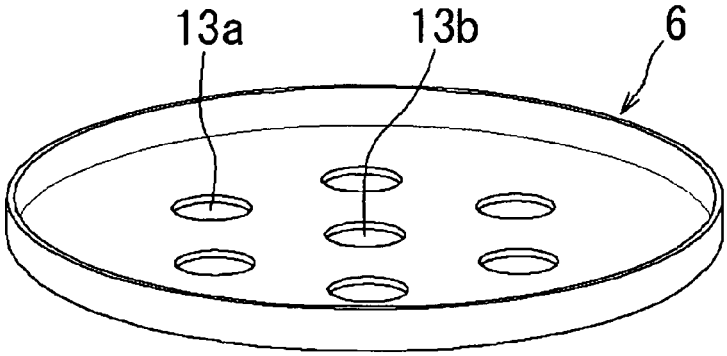
FIG. 17 is a cross section view showing the altered form of the cover used in the multi-function vibrating actuator device of the present invention.

When the multi-function vibrating actuator device involved in the first embodiment is mounted in a piece of portable terminal equipment and the vibration characteristics are measures through the outer case, the results are as shown by the solid curve in FIG. 15. It can be seen from this curve that the vibrations converge at zero more quickly than the conventional vibration characteristics represented by the long-and-short dash curve. Accordingly, the residual noise as heard by the ears of users of the portable terminal equipment is greatly reduced. Therefore, the users perception of the strange noise is reduced.

Figure 28:
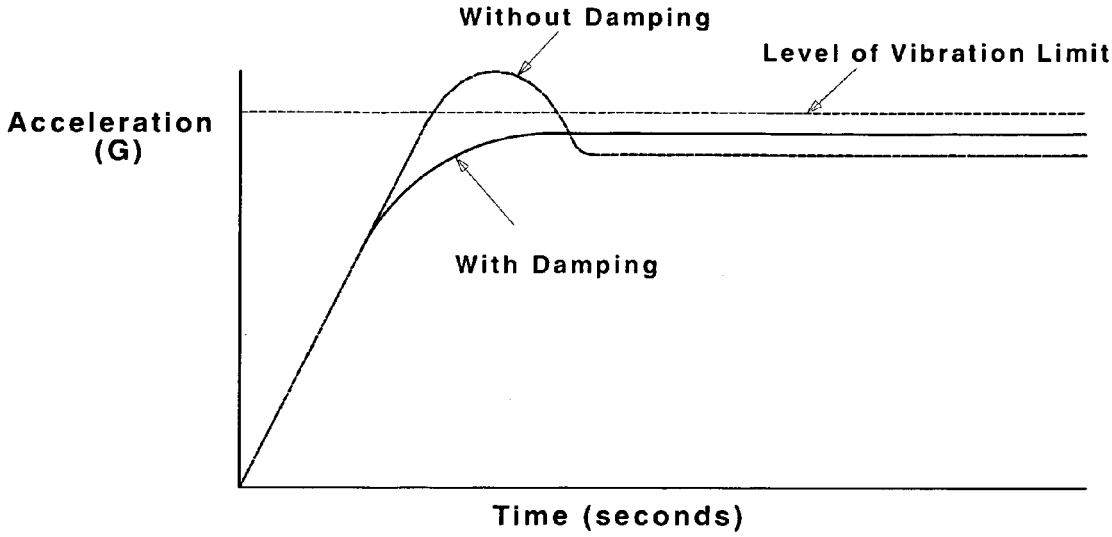
FIG. 28 is a diagram that explains the rise characteristics of the multi-function vibrating actuator device of the present invention.

Further, the multi-function vibrating actuator of the present invention has improved vibration rise characteristics, as shown in FIG. 28. That is, in the case without damping (with no limitation of the movement of the air by the clearance G2, as in the conventional actuator), as represented by the broken curve, when the constant-state acceleration is set at a value close to the vibration threshold level, the acceleration exceeds the vibration threshold level before reaching the constant state; this produces a strange sound. By contrast, in the case with damping (with limitation of the movement of the air by the clearance G2, as in the actuator of the present invention), as represented by the solid curve, the rise characteristics are stable. Further, because the amplitude is attenuated more quickly, acceleration does not exceed the vibration threshold level. Therefore, the occurrence of strange noises can be prevented.

<Other Embodiments>

The embodiments described above have been explained as the first and second embodiments that have air passage holes 10*a* through 10*c* opened in the side of the housing 1 and the third embodiment that has through holes 12*a* through 12*c* in the yoke 20, in addition to air passage holes 10*a* through 10*c*. Beside these embodiments, it is also possible to constitute this multi-function vibrating actuator device with air passage holes 13*a*, 13*b* etc. in the cover 6 and no holes in the housing 1. It is also possible to constitute the invention by putting air passage holes (not illustrated) in the diaphragm, within a range that does not alter the vibration characteristics.

<Alternative Forms>

Figure 18:
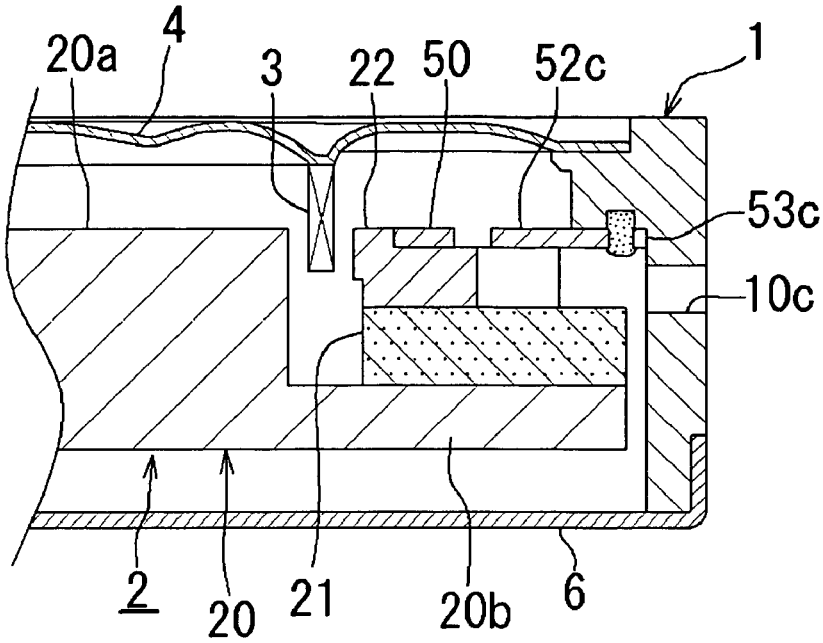
FIG. 18 is a cross section view showing another altered form of the assembled constitution used in the multi-function vibrating actuator device of the present invention.

The embodiments described above were explained on the basis of the attachment blades 53*a* through 53*c* of the spring arms 52*a* through 52*c* of the suspension 5 being fixed into the air passage holes 10*a* through 10*c* in the housing 1. Aside from that, it is possible to have an alternate constitution with a shelf in the inside of the housing 1, as shown in FIG. 18, to which the attachment blades 53*a* through 53*c* are fastened as a way of holding the suspension 5 and the magnetic circuit 2 within the housing 1.

Figure 19:
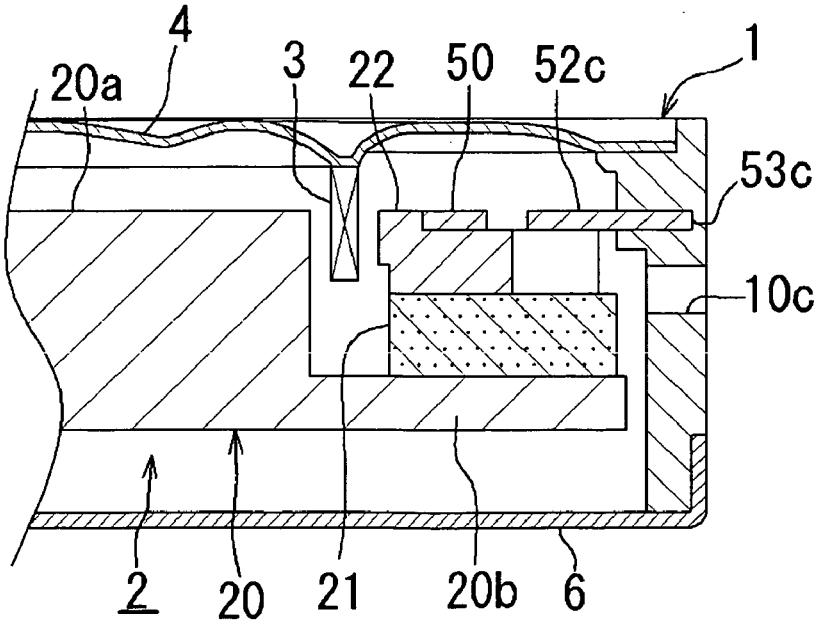
FIG. 19 is a cross section view showing an altered form of the magnetic circuit and yet another altered form of the assembled constitution used in the multi-function vibrating actuator device of the present invention.
Figure 20:
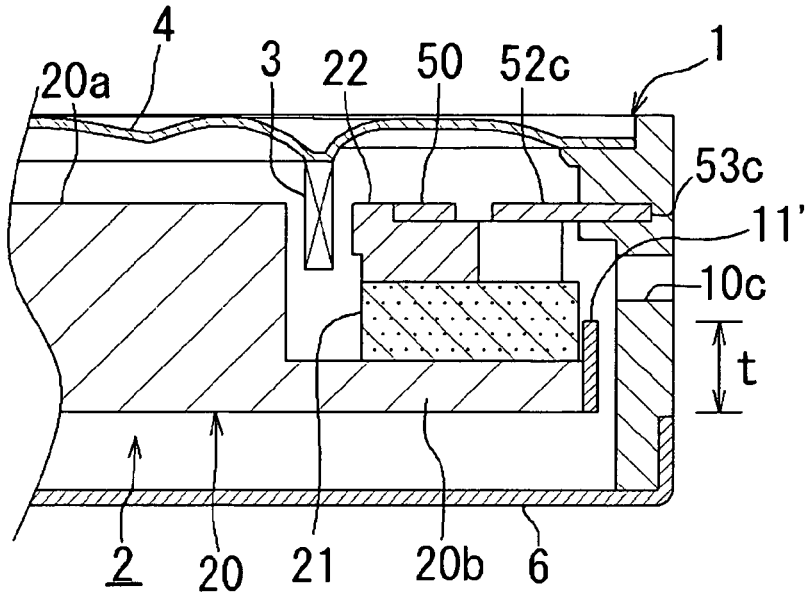
FIG. 20 is a cross section view showing an altered form in which a ring is fitted to the magnetic circuit of FIG. 19.

It is also possible to hold the suspension 5 within the housing 1 as shown in FIG. 19, by having the spring arms 52*c* (only one illustrated) of the suspension 5 form an insert that is a single unit with the housing 1. But using a constitution of this sort, the holding strength of the suspension 5 can be increased, and with the increase in its holding strength the magnetic circuit 2 is held more firmly within the housing 1, so that the resonant frequency of the magnetic circuit 2 is maintained stable, with no scattering. This is preferable to the examples of implementation shown above.

Figure 21:
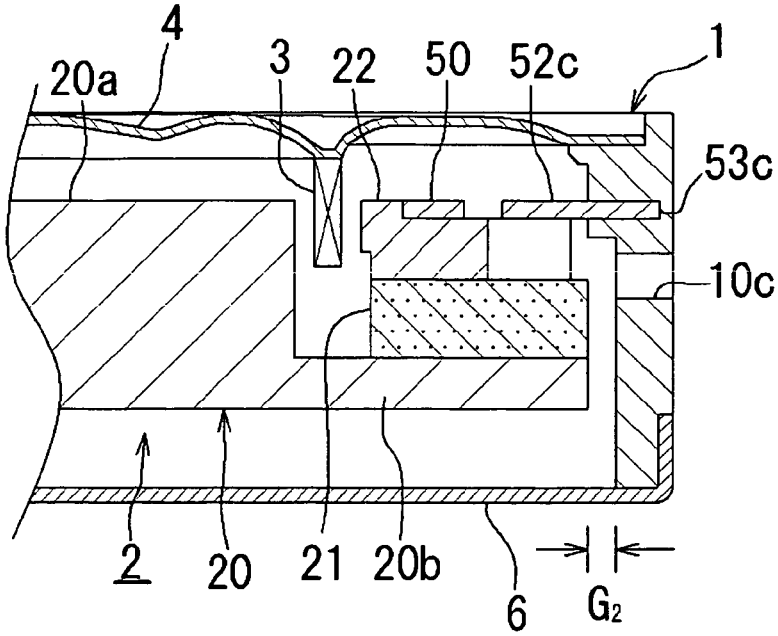
FIG. 21 is a cross section view showing yet another altered form of the magnetic circuit used in the multi-function vibrating actuator device of FIG. 19.

In the alternative form shown in FIG. 19, the magnet 21 is formed slightly smaller than the outside diameter of the yoke 20, so that there is no danger of contacting the inner rim of the housing 1 when the magnet 21 is at top dead center during vibration. In this case, when a ring 11 is fitted over the outer surface of the yoke 20, it is desirable from the perspective of convenience of the damper function to use a ring 11' that has a thickness measurement t that covers the outer surface of the magnet 21. Further, it is desirable that the yoke 20 and the magnet 21 have the same outside diameter, as shown in FIG. 21, as long as it is possible to set the measurement of the clearance G2 at more than 0% and not more than 2.5% of the inside diameter of the housing 1, or more than 0 mm and not more than 0.2 mm, preferably at least 0.05 mm and not more than 0.15 mm.

Figure 22:
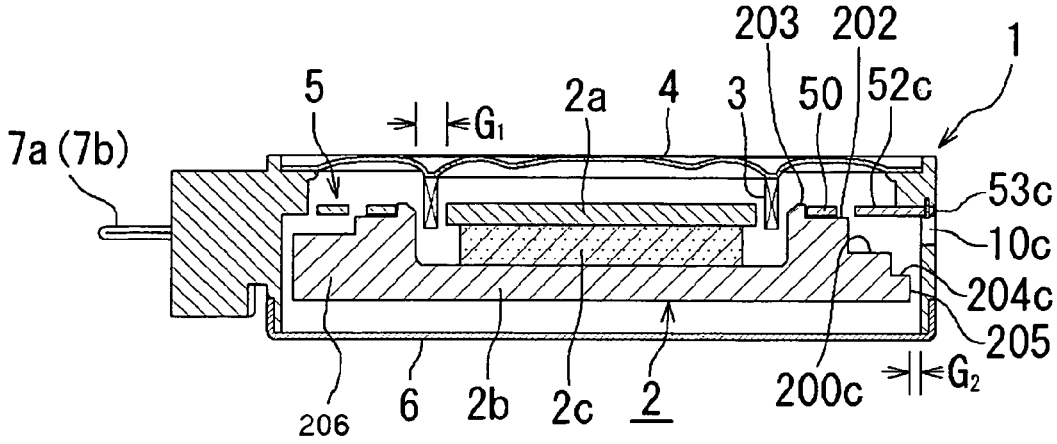
FIG. 22 is a cross section view showing the inner magnet type of multi-function vibrating actuator device of the present invention.

The modes described above are explained on the basis of a multi-function vibrating actuator device of the outer-magnet type, but the invention is also appropriate to the constitution of a multi-function vibrating actuator device as in FIG. 22, with an inner-magnet type of magnetic circuit 2 formed by fastening a pole piece 2*a* and yoke 2*b* to the magnet 2*c* so as to create a gap G1 that functions as the magnetic gap. The outer surface of the yoke 2*b* should be in close proximity to the inner surface if the housing 1, so that the clearance G2 is set at more than 0% and not more than 2.5% of the inside diameter of the housing 1, or more than 0 mm and not more than 0.2 mm, preferably at least 0.05 mm and not more than 0.15 mm.

Figure 23:
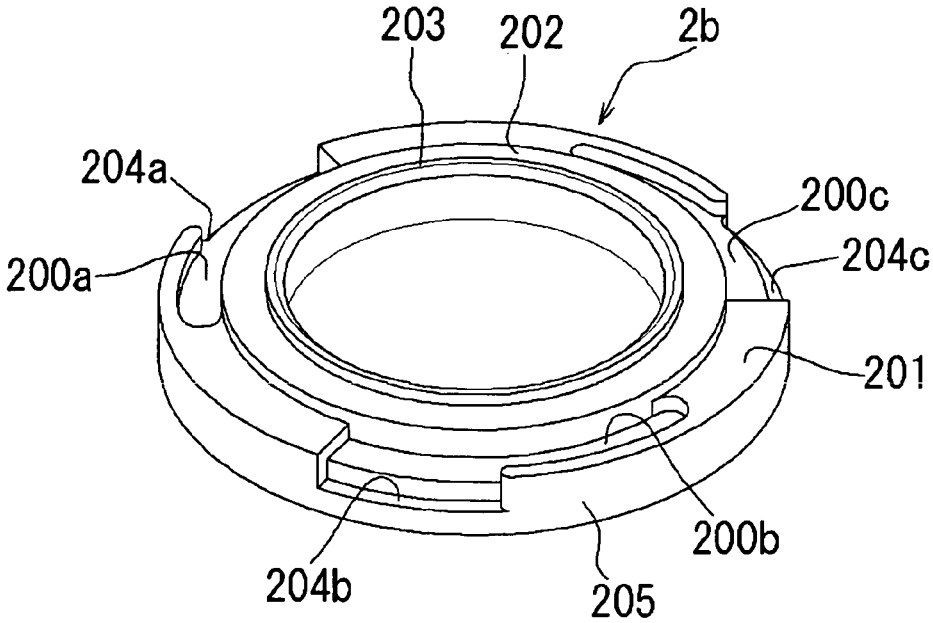
FIG. 23 is an exploded perspective view showing the yoke to be assembled in the multi-function vibrating actuator device of FIG. 22.

In the case of this inner-magnet type to magnetic circuit 2, the yoke 2*b* has a stepped surface 201, as shown in FIG. 23, in which recessed run-offs 200*a* through 200*c* face the spring arms of the suspension 5 so that there is no contact with the spring arms when the spring arms of the suspension flex in the course of bodily-sensible vibration. This stepped surface 201 steps down from the upper surface 202 to which the ring portion of the suspension is fixed. A retaining ring 203 with an outside diameter that fits into ring portion of the suspension rises from the upper surface 202 of the yoke 2*b*.

In addition, recessed run-offs 204*a* through 204*c* are notched into the outer rim to open the sides of the recessed run-offs 200*a* through 200*c*. In the event that a shelf is recessed into the inner wall of the housing and the attachment blades of the spring arms of the suspension are fixed to the shelf, these are recessed into the outer rim of the yoke 2*b* to prevent contact with the projecting edge of the shelf.

Now, in this embodiment the movable parts are the magnetic circuit 2 that comprises the pole piece 2*a,* the yoke 2*b,* and the magnet 2*c,* and also a projection 206 that is formed as a single unit in the radial direction of the yoke 2*b*.

Figure 29:
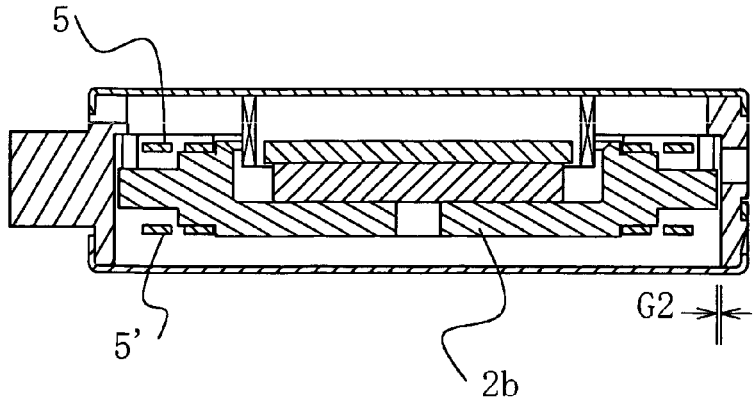
FIG. 29 is a cross section view showing the double suspension type of multi-function vibrating actuator device of the present invention.

The terms and expressions used above in this specification are simply for the purpose of explanation, and do not limit the content of the invention in any way. Accordingly, although the embodiments described above were explained as having a single suspension, the invention is also appropriate to a type with two suspensions 5, 5', like the multi-function vibrating actuator device shown in FIG. 29. That is, in the case of the multi-function vibrating actuator device shown in FIG. 29, the close approach of the side of the yoke 2*b* to the inside of the housing creates a clearance G2 that limits the amount of air movement.

Further, the embodiments described above were explained with examples of outer-magnet type of multi-function vibrating actuators and inner-magnet type of multi-function vibrating actuators, but the invention is not limited to these types. Accordingly, although they are not illustrated, the invention is also appropriate to radial-allocation type multi-function vibrating actuator devices. That is, by having the side of the moving part or the magnetic circuit of a radial-allocation type multi-function vibrating actuator device closely approach the inside of the housing, it is possible to form a clearance that limits the movement of air. Further, the structure of the magnetic circuit or moving part is not limited to the structure explained in the modes described above.

Moreover, the embodiments described above were explained using as an example the type of housing in which both ends are open and a cover is placed on the open end opposite the diaphragm, but the present invention is not limited by that; it is also possible for the housing to be formed as a tube with a closed bottom.

Figure 30:
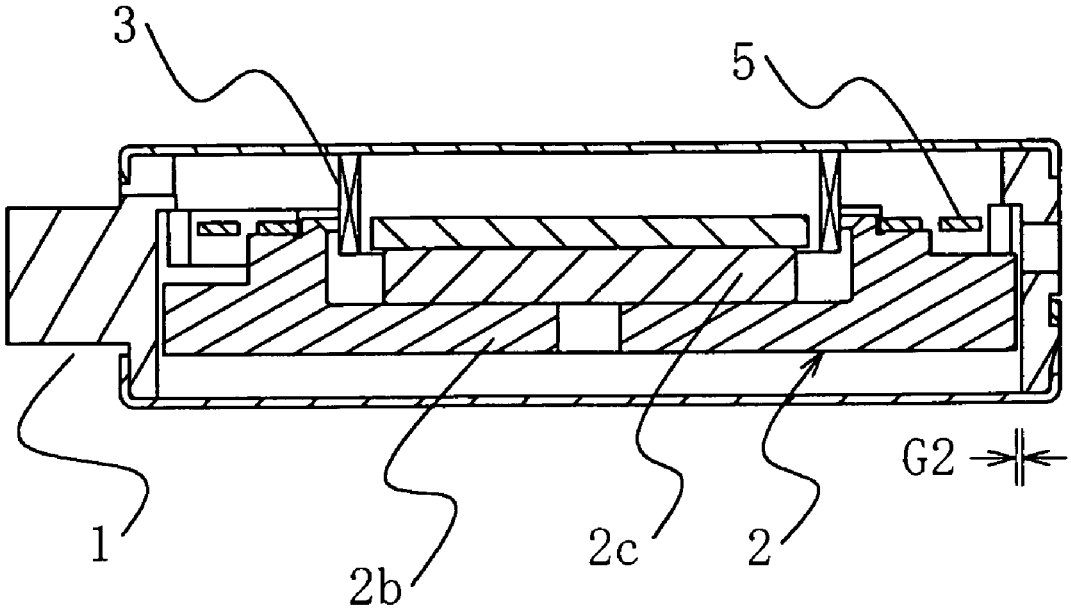
FIG. 30 is a cross section view showing the vibrating actuator device of the present invention.

Further, the embodiments described above were explained with examples of multi-function vibrating actuator devices that have generative functions such as ring tones, but the present invention is not limited to these multi-function vibrating actuator devices; it can be applied to a vibrating actuator as shown in FIG. 30.

As stated above, even if limiting terms and expressions have been used in the specification, there is no intention to exclude equivalents of the present invention or portions thereof. Therefore, it is possible to add a variety of changes to the range of the invention for which rights are claimed

INDUSTRIAL APPLICABILITY

As stated above, according to the multi-function vibrating actuator device of claims 1 through 5 of the present invention, it is possible to expand the frequency range that yields the bodily-sensible vibrations required for notification of incoming calls, by using the interior air of the device as a damper to block the up and down vibrating motion of the magnetic circuit. This makes it possible to obtain the acceleration required for bodily-sensible vibrations over a broader range of frequencies, and so it is easy to set the point of resonance without the point of resonance drifting out of the frequency range. Therefore, it is easier to obtain the desired frequency acceleration, and so the stability and utility of bodily-sensible vibration characteristics is improved.

In addition to that, it is possible to ease the drop-off of acceleration relative to the amplitude of changes of frequency. Because of that, it is possible to prevent a sharp drop-off of bodily-sensible vibrations when slippage of the point of resonance in individual devices occurs during manufacture and causes scattering of the bodily-sensible vibration characteristics, or when there is resonance point slippage because of variation in the environments for use of the portable terminals in which the multi-function vibrating actuator devices are mounted. It is thus possible to prevent the occurrence of situations in which the required amount of bodily-sensible vibrations is not obtained.

Further, by using the air within the device as a damper, as described above, and blocking the up and down vibrating motion of the magnetic circuit by means of that damper action, it is possible to reduce strange sounds when the portable terminal equipment is in the state of awaiting incoming calls. Moreover, by changing the size of the diameter of the magnetic circuit, it is possible to change the bodily-sensible vibration characteristics in accordance with the demands of individual producers of portable terminal equipment.

According to the multi-function vibrating actuator device of claim 3 of the present invention, it is possible to change the vibration characteristics of the magnetic circuit by putting through holes in the magnetic circuit, and thus to easily assemble the device according to individual demands, and to change bodily-sensible vibration characteristics while suppressing production costs and the time and labor used in manufacture.

According to the multi-function vibrating actuator device of claim 4 of the present invention, it is possible to fit a ring of matching shape to the outer surface of the magnetic circuit and to adjust the clearance between the outside of the ring and the inside surface of the housing by means of the size of the ring in the facial direction. Because of that, the multi-function vibrating actuator device can be assembled more easily in accordance with the demands of the manufacturer, and it is possible to freely vary the sharpness of resonance, drop-off of acceleration, and the width of the frequency range while suppressing production costs and the time and labor used in manufacture.

The multi-function vibrating actuator device or vibrating actuator device according to claims 6 through 9 of the present invention applies a damper to the magnetic circuit or moving part by using the air resistance when the interior air passes through the clearance. Because the clearance is greater than 0 mm but not greater than 0.2 mm, air resistance is created, and so the rise characteristics and fall characteristics of the multi-function vibrating actuator device or vibrating actuator device are smoothed out, and control of vibration becomes easier. Further, it is possible to expand the width of the frequency range that yields the bodily-sensible vibrations necessary for incoming call notification. Because of that, the acceleration needed for bodily-sensible vibrations can be obtained over a broader range of frequencies, and so it is easier to set the point of resonance without the point of resonance drifting from the frequency range. It is therefore easier to obtain the required vibration acceleration, and the stability and utility of bodily-sensible vibration characteristics can be improved.

The invention claimed is:

1. A multi-function vibrating actuator device, in which there are provided an outer-magnet type of magnetic circuit including a discal yoke with a pole piece at a center thereof, a yoke plate and a ring magnet as a single unit, forming a gap that functions as a magnetic gap between an outer face of the pole piece and respective inner faces of the magnet and yoke plate, a diaphragm fastened to an top of a voice coil, a suspension including a plurality of spring arms that extend along an outer periphery thereof from a support portion for supporting the magnetic circuit, a substantially cylindrical housing that is open on both ends thereof, and a cover, the magnetic circuit being supported within the housing by the suspension, tips of the spring arms of which are attached to the sides of the housing, the voice coil being located within the magnet gap, the opening at one end of the housing being covered by the diaphragm with an outer edge of the diaphragm being attached to a rim of the opening of the housing and the opening at the other end of the housing being covered by the cover with an outer edge of the cover being attached to a rim of the opening of the housing, and the magnetic circuit being made vibrate within the housing by an electrical signal being applied to the voice coil, wherein an air passage hole is formed at least at one part among said housing, cover and diaphragm, and said magnetic circuit is assembled with an outer surface thereof in close proximity to an inner surface of the housing so as to create a clearance between an outer surface of the magnetic circuit and an inner surface of the housing, wherein said clearance is adjusted to be more than 0% and not more than 2.5% of the inside radius of the housing so that a range of frequencies at which said magnetic circuit is able to vibrate can be expanded by restricting the amount of movement of interior air in a space formed by said diaphragm and said magnetic circuit and of interior air in a space formed by said magnetic circuit and said cover.

2. The multi-function vibrating actuator device of claim 1, wherein said yoke plate includes a ring with brim projections at an outer periphery of the ring in accordance with the number of spring arms, the brim projections being arranged so as not to overlap points of attachment between said housing and suspension.

3. The multi-function vibrating actuator device of claim 1 or 2, wherein a through hole is formed in said magnetic circuit.

4. A multi-function vibrating actuator device, in which there are provided an outer-magnet type of magnetic circuit including a discal yoke with a pole piece at a center thereof, a yoke plate and a ring magnet as a single unit, forming a gap that functions as a magnetic gap between an outer face of the pole piece and respective inner faces of the magnet and yoke plate, a diaphragm fastened to an top of a voice coil, a suspension including a plurality of spring arms that extend along an outer periphery thereof from a support portion for supporting the magnetic circuit, a substantially cylindrical housing that is open on both ends thereof, and a cover, the magnetic circuit being supported within the housing by the suspension, tips of the spring arms of which are attached to the sides of the housing, the voice coil being located within the magnet gap, the opening at one end of the housing being covered by the diaphragm with an outer edge of the diaphragm being attached to a rim of the opening of the housing and the opening at the other end of the housing being covered by the cover with an outer edge of the cover being attached to a rim of the opening of the housing, and the magnetic circuit being made vibrate within the housing by an electrical signal being applied to the voice coil, wherein an air passage hole is formed at least at one part among said housing, cover and diaphragm, and a ring is fitted around an outer periphery of said magnetic circuit so as to create a clearance between an outer surface of the ring and an inner surface of the housing, wherein said clearance is adjusted to be more than 0% and not more than 2.5% of the inside radius of the housing so that a range of frequencies at which said magnetic circuit is able to vibrate can be expanded by restricting the amount of movement of interior air in a space formed by said diaphragm and said magnetic circuit and of interior air in a space formed by said magnetic circuit and said cover.

5. A multi-function vibrating actuator device, in which there are provided an inner-magnet type of magnetic circuit in which a pole piece and a yoke are fixed to a magnet as a single unit, forming a gap that functions as a magnetic gap, a diaphragm fastened to an top of a voice coil, a suspension including a plurality of spring arms that extend along an outer periphery thereof from a support portion for supporting the magnetic circuit, a substantially cylindrical housing that is open on both ends thereof, and a cover, the magnetic circuit being supported within the housing by the suspension, tips of the spring arms of which are attached to the sides of the housing, the voice coil being located within the magnet gap, the opening at one end of the housing being covered by the diaphragm with an outer edge of the diaphragm being attached to a rim of the opening of the housing and the opening at the other end of the housing being covered by the cover with an outer edge of the cover being attached to a rim of the opening of the housing, and the magnetic circuit being made vibrate within the housing by an electrical signal being applied to the voice coil, wherein an air passage hole is formed at least at one part among said housing, cover and diaphragm, and said magnetic circuit is assembled with an outer surface thereof in close proximity to an inner surface of the housing so as to create a clearance between an outer surface of the magnetic circuit and an inner surface of the housing, wherein said clearance is adjusted to be more than 0% and not more than 2.5% of the inside radius of the housing so that a range of frequencies at which said magnetic circuit is able to vibrate can be expanded by restricting the amount of movement of interior air in a space formed by said diaphragm and said magnetic circuit and of interior air in a space formed by said magnetic circuit and said cover.

6. A multi-function vibrating actuator device, comprising:

a magnetic circuit forming a magnetic path;

a suspension supporting said magnetic circuit;

a diaphragm being placed facing said magnetic circuit;

a voice coil being inserted into a magnetic gap formed in said magnetic circuit; and a housing enclosing said magnetic circuit, wherein said magnetic circuit is placed so as to create a clearance between an outer surface of the magnetic circuit and an inner surface of said housing, and said clearance is adjusted to be more than 0 mm and not more than 0.2 mm so that a range of frequencies at which said magnetic circuit is able to vibrate can be expanded by restricting the amount of movement of air passing through the clearance.

7. A multi-function vibrating actuator device, comprising:

a movable part including a magnetic circuit that forms a magnetic path and a brim that extends in a radial direction of the magnetic circuit;

a suspension supporting said movable part;

a diaphragm being placed facing said movable part;

a voice coil being inserted into a magnetic gap formed in said magnetic circuit; and a housing enclosing said movable part, wherein said movable part is placed so as to create a clearance between an outer surface of the movable part and an inner surface of said housing, and said clearance is adjusted to be more than 0 mm and not more than 0.2 mm so that a range of frequencies at which said magnetic circuit is able to vibrate can be expanded by restricting the amount of movement of air passing through the clearance.

8. A vibrating actuator device, comprising:

a magnetic circuit forming a magnetic path;

a suspension supporting said magnetic circuit;

a voice coil being inserted into a magnetic gap formed in said magnetic circuit; and a housing enclosing said magnetic circuit, wherein said magnetic circuit is placed so as to create a clearance between an outer surface of the magnetic circuit and an inner surface of said housing, and said clearance is adjusted to be more than 0 mm and not more than 0.2 mm so that a range of frequencies at which said magnetic circuit is able to vibrate can be expanded by restricting the amount of movement of air passing through the clearance.

9. A vibrating actuator device, comprising:

a movable part including a magnetic circuit that forms a magnetic path and a brim that extends in a radial direction of the magnetic circuit;

a suspension supporting said movable part;

a voice coil being inserted into a magnetic gap formed in said magnetic circuit; and a housing enclosing said movable part, wherein said movable part is placed so as to create a clearance between an outer surface of the movable part and an inner surface of said housing, and said clearance is adjusted to be more than 0 mm and not more than 0.2 mm so that a range of frequencies at which said magnetic circuit is able to vibrate can be expanded by restricting the amount of movement of air passing through the clearance.

* * * * *